US010221041B2

(12) United States Patent
Wang et al.

(10) Patent No.: US 10,221,041 B2
(45) Date of Patent: Mar. 5, 2019

(54) MOBILE CAR SHEAVE SHIELD

(71) Applicant: Otis Elevator Company, Farmington, CT (US)

(72) Inventors: Lan Wang, Hangzhou (CN); Guohua Zhang, Hangzhou (CN); Xing Mao, Hangzhou (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 261 days.

(21) Appl. No.: 15/108,890

(22) PCT Filed: Dec. 29, 2014

(86) PCT No.: PCT/US2014/072519
§ 371 (c)(1),
(2) Date: Jun. 29, 2016

(87) PCT Pub. No.: WO2015/103117
PCT Pub. Date: Jul. 9, 2015

(65) Prior Publication Data

US 2016/0325963 A1 Nov. 10, 2016

(30) Foreign Application Priority Data

Dec. 31, 2013 (CN) ..... 2013 1 0755224

(51) Int. Cl.
*B66B 5/00* (2006.01)

(52) U.S. Cl.
CPC ..... *B66B 5/005* (2013.01)

(58) Field of Classification Search
CPC ..... B66B 5/0043; B66B 5/005; B66B 5/0087; B66B 7/08; B66B 11/0035; B66B 11/004;
(Continued)

(56) References Cited

U.S. PATENT DOCUMENTS 6,722,475 B2 * 4/2004 Miller ..... B66B 11/02 187/266
8,302,740 B2 * 11/2012 Swaybill ..... B66B 7/08 187/254

(Continued)

FOREIGN PATENT DOCUMENTS

WO 2013084310 A1 6/2013

OTHER PUBLICATIONS

International Search Report for application PCT/US2014/072519, dated Mar. 2, 2015, 5 pages.

(Continued)

*Primary Examiner* — Minh Truong
(74) *Attorney, Agent, or Firm* — Cantor Colburn LLP

(57) ABSTRACT

A mobile car sheave shield comprises a static shield part 2 sleeved on a car sheave 1, wherein an opening is formed on upper of the static shield part; a dynamic shield part is arranged on the opening; the dynamic shield part comprises a shield bracket 3; an inner side mobile shield 4 and an outer side mobile shield 5 which are synchronously connected are respectively arranged on two sides of a central axis of the shield bracket from inside to outside; the outer side mobile shield and the inner side mobile shield are slidingly connected on the shield bracket. The present invention has the advantages that: by combining the static shield part and the dynamic shield part, the dynamic shield part is moved by the traction rope, to realize mobile protection of the shield, thus offering a clearance constantly meeting safety requirement and guaranteeing safety of a car top worker.

7 Claims, 3 Drawing Sheets

(58) Field of Classification Search
CPC ..... B66B 11/0045; B66B 11/005; B66B 11/0065; B66B 11/0206
See application file for complete search history.

(56) References Cited

U.S. PATENT DOCUMENTS

2008/0289908 A1* 11/2008 Murao ..... B66B 11/0206 187/266
2011/0240407 A1* 10/2011 Ericson ..... B66B 11/002 187/250

OTHER PUBLICATIONS

Written Opinion for application PCT/US2014/072519, dated Mar. 2, 2015, 5 pages.

* cited by examiner

MOBILE CAR SHEAVE SHIELD

TECHNICAL FIELD

The present invention relates to an elevator device, and more specifically, relates to a mobile car sheave shield capable of meeting requirement and guaranteeing safety of a worker.

TECHNICAL BACKGROUND

With the increasing development of elevator system arrangement, more and more elevators are arranged by a V-shaped traction system. Generally, car of this traction system adopts arrangement of car sheave, and has an obvious characteristic that an included angle between suspension ropes running through two sides of the car sheave varies as the elevator moves up and down in a shaft, rather than 0 degree as conventional system. Car top of the elevator often serves as a working platform for maintenance or installation personnel; the car sheave, as a rotating part, is on a position that a worker can reach, and the car sheave is reasonably protected to avoid unintentional injury of the worker. But in the V-shaped traction system, the included angle between the suspension ropes on two sides of the car sheave is variable. Normal static shield fails to offer a safety clearance meeting GB12265.1.

SUMMARY

In order to solve a problem that common shield in an existing V-shaped traction system fails to offer a safety clearance meeting safety requirement, there is provided a mobile car sheave shield capable of meeting requirement and guaranteeing safety of a worker.

The above technical problem of the present invention is solved mainly through a technical solution as follows: there is provided a mobile car sheave shield, which comprises a static shield part sleeved on a car sheave, wherein an opening is formed on upper of the static shield part; a dynamic shield part is arranged on the opening; the dynamic shield part comprises a shield bracket; an inner side mobile shield and an outer side mobile shield which are synchronously connected are respectively arranged on two sides of a central axis of the shield bracket from inside to outside; the outer side mobile shield and the inner side mobile shield are slidingly connected on the shield bracket; a notch is formed between the outer side mobile shield and the inner side mobile shield, and a traction ropes runs through the notch. By combining the static shield part and the dynamic shield part, the dynamic shield part is moved by the traction rope when the angle of the traction rope of the V-shaped traction rope system is changed, thus realizing mobile protection of the shield, so as to offer a clearance constantly meeting GB12265.1 requirement and guaranteeing safety of a car top worker.

As a preferred solution, the shield bracket is presented in a square block; guide grooves are respectively formed on the inner sides of edge frames in a length direction of the shield bracket; slide bars are respectively arranged at two ends of the outer side mobile shield and the inner side mobile shield, and the front ends of the slide bars are embedded in the guide grooves. Through the structures, the outer side mobile shield and the inner side mobile shield move in the shield bracket, and clearance between the outer side mobile shield and the inner side mobile shield moves as well, thus realizing mobile protection.

As a preferred solution, a support frame is arranged on a central axis of the shield bracket; two electric contact switches facing opposite directions are arranged on the support frame, and springs are respectively arranged on two sides of the support frame; the front ends of the springs are connected to the inner side mobile shield on this side. Controlled by the electric contact switches, the elevator enters into a maintenance running state or not; the elevator is under a normal running state when the electric contact switches are triggered and the elevator is under the maintenance running state when the electric contact switches are released. When the elevator runs normally, the inner side mobile shield separates from the outer side mobile shield, the inner side mobile shield presses on the electric contact switch on this side under the function of the spring and the traction rope fails to contact with the inner side mobile shield and the outer side mobile shield even changing the angle in whole process, at which time no worker stands on the car top and the dynamic shield part is idle. When the elevator is maintained, the inner side mobile shield is connected with the outer side mobile shield, and the dynamic shield part takes an effect.

As a preferred solution, a connecting rod is arranged between the inner side mobile shield and the outer side mobile shield; claws are respectively arranged at two ends of the connecting rod; the claw at one end of the connecting rod is fastened on a slide bar of the inner side mobile shield, and the claw at the other end of the connecting rod is fastened on a slide bar of the outer side mobile shield. Through the connecting rod, the inner side mobile shield and the outer side mobile shield are integrally connected, so that the inner side mobile shield and the outer side mobile shield can advance and run synchronously; meanwhile, the notch between the shields is constantly non-standard low. In addition, the connecting rod, which is in mobile connection, can be fastened and released conveniently. No worker stands on the car top when the elevator is under a normal running state, at which time the connecting rod releases from the slide bar of the inner side mobile shield, while the inner side mobile shield moves towards the support rod under the function of the spring and is tightly pressed on the electric contact switch. When the worker enters the car top and the elevator is maintained, the inner side mobile shield is pulled towards the outer side mobile shield, and is fixed with the outer side mobile shield through the connecting rod, so that the electric contact switches are released and the elevator enters the maintenance running state.

As a preferred solution, both the inner side mobile shield and the outer side mobile shield are provided with upper shield plates on the upper side and lower shield plates on the lower sides; the two upper shield plates are relatively parallel and the two lower shield plates are oppositely parallel, and fixed roller mechanisms are respectively arranged in the middles of opposite surfaces of the inner side mobile shield and the outer side mobile shield. The inner side mobile shield and the outer side mobile shield are Z-shaped structures and are relatively arranged; a notch is formed between the two upper shield plates, and openings of the static shield part on the two sides of the notch are baffled by the lower shield plate. By setting the fixed roller mechanisms which are parts in contact with the dynamic shield part under pushing of the traction rope, abrasion of the traction rope is avoided through rolling friction and service life of the traction rope is prolonged. In addition, a protection function is offered to the fixed roller mechanisms through the upper shield plate, so as to protect the worker from directly contacting with the fixed roller mechanisms.

As a preferred solution, the fixed roller mechanism comprises a shaft base on the inner side mobile shield or outer side mobile shield; a rolling shaft is arranged on the shaft base; a bearing is fixed on the rolling shaft; a roller is fixed on the bearing, and the front end of the roller is exposed out of the front end of the upper shield plate, so that the traction rope, when being pushed, is in contact with the roller, thus avoiding abrasion of the traction rope and prolonging service life of the traction rope.

As a preferred solution, the outer side mobile shield is a structure which is inclined inwards. Depending on situation of the traction rope, the traction rope is inclined when extending, and the outer side mobile shield is inclined correspondingly so as to better match with the traction rope.

Therefore, the present invention has the advantages that: by combining the static shield part and the dynamic shield part, the dynamic shield part is moved by the traction rope, to realize mobile protection of the shield, thus offering a clearance constantly meeting safety requirement and guaranteeing safety of a car top worker.

1-car sheave; 2-static shield part; 3-shield bracket; 4-outer side mobile shield; 5-inner side mobile shield; 6-support frame; 7-electric contact switch; 8-spring; 9-connecting rod; 10-slide bar; 11-claw; 12-guide groove; 13-upper shield plate; 14-lower shield plate; 15-rolling shaft; 16-bearing; 17-roller; 18-traction rope

DETAILED DESCRIPTION

The present invention shall be further described in detail hereinafter in conjunction with the accompanying drawings and the embodiments.

Embodiments

Figure 1:
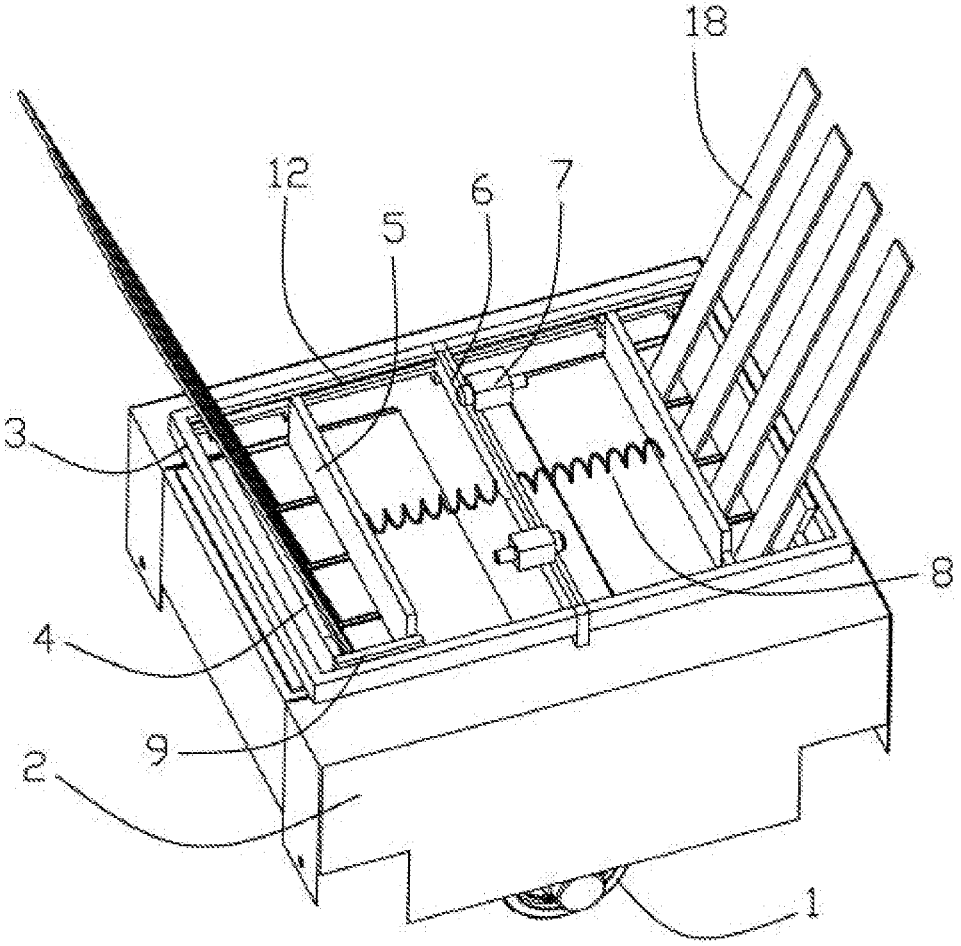
FIG. 1 is a schematic diagram of the structure according to the present invention.
Figure 2:
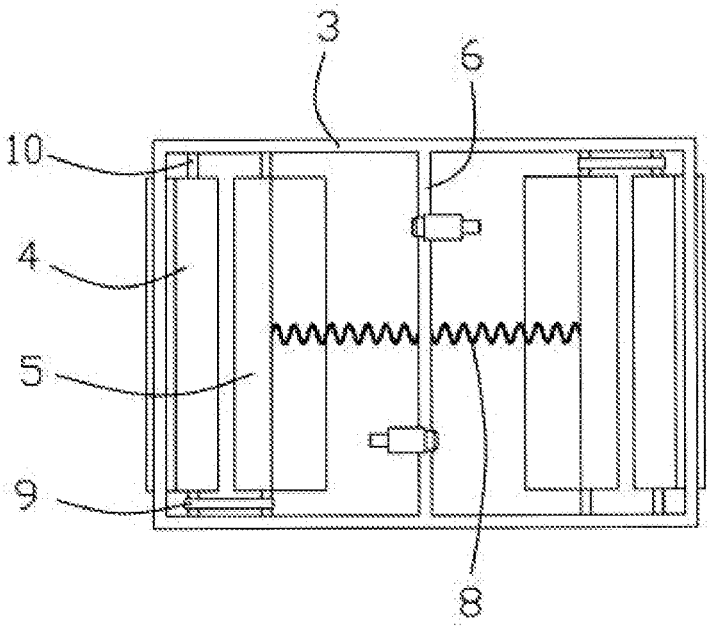
FIG. 2 is a top view of the structure according to the present invention.

According to the embodiment of the present invention, there is provided a mobile car sheave shield, which, as shown in FIG. 1 and FIG. 2, comprises a static shield part 2 which covers outside of car sheave 1; an opening is arranged on the upper surface of the static shield part, and a dynamic shield part is arranged in the opening.

The dynamic shield part comprises a shield bracket 3 which is a square block structure; a support frame 6 is arranged on the central axis of the shield bracket to divide the shield bracket into a left side and a right side, and an inner side mobile shield 5 and an outer side mobile shield 4 are respectively arranged on each side from inside to outside. Both the inner side mobile shield and the outer side mobile shield are slidingly connected on the shield bracket; guide grooves 12 are respectively arranged on the inner sides of edge frames in a length direction of the shield bracket, and slide bars 10 are arranged at two ends of the inner side mobile shield and the outer side mobile shield; the front ends of the slide bars are embedded in the guide grooves.

Figure 3:
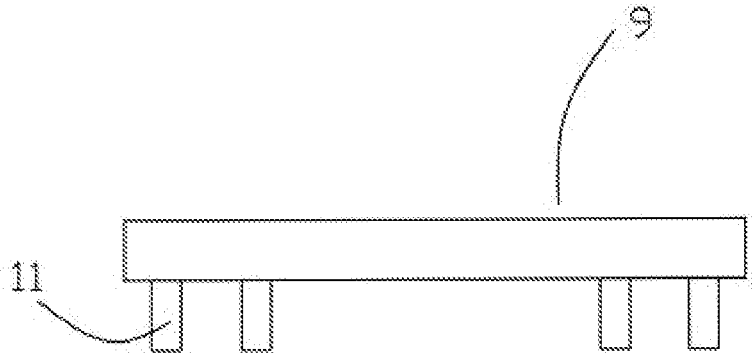
FIG. 3 is a schematic diagram of a circuit structure in the connecting rod according to the present invention.

A connecting rod 9 is connected between the inner side mobile shield and the outer side mobile shield, thus synchronously connecting the inner side mobile shield and the outer side mobile shield. As shown in FIG. 2 and FIG. 3, claws 11 are respectively arranged at two ends of the connecting rod; the claw at one end of the connecting rod is fastened on the slide bar of the inner side mobile shield and the claw at the other end of the connecting rod is fastened on the slide bar of the outer side mobile shield. A clearance is formed between the inner side mobile shield and the outer side mobile shield, and the traction rope 18 runs through the clearance.

Two electric contact switches 7 facing opposite directions are arranged on the support frame, and springs 8 are respectively arranged on two sides of the support frame; the front ends of the springs are connected to the inner side mobile shield on this side.

Figure 4:
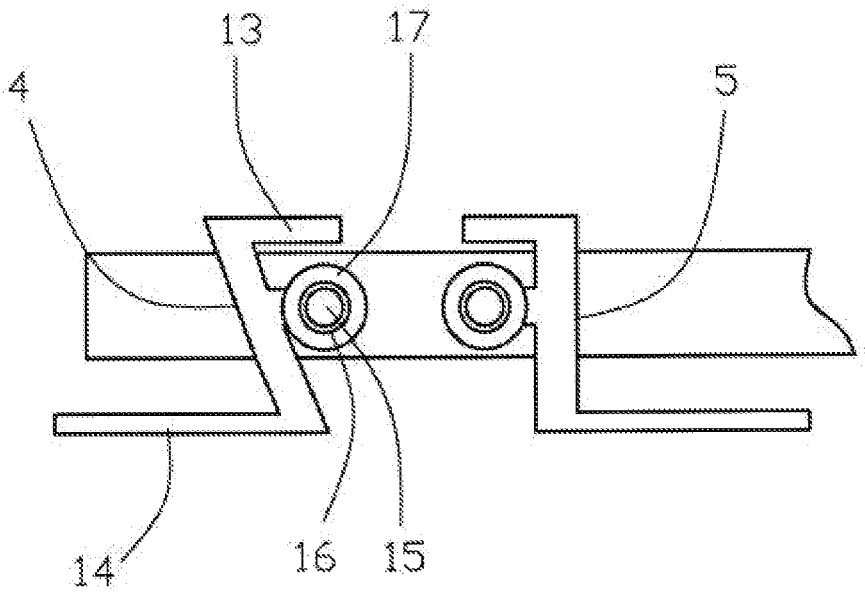
FIG. 4 is a side-looking structure schematic diagram of the outer side mobile shield and the inner side mobile shield according to the present invention.

As shown in FIG. 4, both the inner side mobile shield 5 and the outer side mobile shield 4 are provided with upper shield plates 13 on the upper side and lower shield plates 14 on the lower sides; the two upper shield plates are relatively parallel and the two lower shield plates are oppositely parallel; the outer side mobile shield is a structure which is inclined inwards. Fixed roller mechanisms are respectively arranged in the middles of opposite surfaces of the inner side mobile shield and the outer side mobile shield. Each fixed roller mechanism comprises a shaft base on either inner side mobile shield or outer side mobile shield; a rolling shaft 15 is arranged on the shaft base; a bearing 16 is fixed on the rolling shaft; a roller 17 is fixed on the bearing, and the front end of the roller is exposed out of the front end of the upper shield plate.

When the elevator runs normally, no worker stands on the car top; the outer side mobile shield and the inner side mobile shield fail to connect together, the outer side mobile shield is on the outermost side while the inner side mobile shield is close to the support frame, at which time the electric contact switches are tightly pressed by the inner side mobile shield under tensions of the springs, so that the elevator is only under a normal running state, rather than a maintenance running state.

When the worker enters the car top to start the elevator for maintenance running, the inner side mobile shield is pulled towards the outer side mobile shield and is fixed with the outer side mobile shield through the connecting rod. The electric contact switches are released, thus realizing maintenance running function of the elevator. The process of drawing and pushing the dynamic shield part just occurs in occasional maintenance running of the elevator, so as to avoid shortening of service life after working for long time.

The embodiments described herein are exemplary and are just for interpretation of the invention. The technicians of the technical field can implement various modification, supplement or deformation in similar ways on the specific embodiments described, not departing from the spirit of the present invention or exceeding scope defined by claims attached.

The specification, although using many terms such as car sheave, static shield part, shield bracket and outer side mobile shield, not rules out possibility of other terms. Those terms are just for conveniently describing and interpreting the nature of the present invention; interpretation of them into any additional limitation is violation of the spirit of the present invention.

The invention claimed is:

1. A mobile car sheave shield comprising:

a static shield part to be positioned about a car sheave, wherein an opening is formed on an upper surface of the static shield part;

a dynamic shield part arranged on the opening;

the dynamic shield part comprises a shield bracket;

an inner side mobile shield and an outer side mobile shield which are connected to each other and arranged on two sides of a central axis of the shield bracket;

wherein the outer side mobile shield and the inner side mobile shield are slidingly connected on the shield bracket;

a notch formed between the inner side mobile shield and the outer side mobile shield, and a traction rope runs through the notch, the traction rope being positioned between the inner side mobile shield and the outer side mobile shield.

2. The mobile car sheave shield according to claim 1, wherein a connecting rod is arranged between the inner side mobile shield and the outer side mobile shield;

claws are respectively arranged at two ends of the connecting rod;

the claw at one end of the connecting rod is fastened on a slide bar of the inner side mobile shield, and the claw at the other end of the connecting rod is fastened on a slide bar of the outer side mobile shield.

3. A mobile car sheave shield comprising:

a static shield part to be positioned about a car sheave, wherein an opening is formed on an upper surface of the static shield part;

a dynamic shield part arranged on the opening;

the dynamic shield part comprises a shield bracket;

an inner side mobile shield and an outer side mobile shield which are connected to each other and arranged on two sides of a central axis of the shield bracket;

wherein the outer side mobile shield and the inner side mobile shield are slidingly connected on the shield bracket;

a notch formed between the inner side mobile shield and the outer side mobile shield, and a traction rope runs through the notch, the traction rope being positioned between the inner side mobile shield and the outer side mobile shield;

guide grooves are respectively formed on the inner sides of edge frames in a length direction of the shield bracket;

slide bars are respectively arranged at two ends of the outer side mobile shield and the inner side mobile shield (5), and front ends of the slide bars are embedded in the guide grooves.

4. A mobile car sheave shield comprising:

a static shield part to be positioned about a car sheave, wherein an opening is formed on an upper surface of the static shield part;

a dynamic shield part arranged on the opening;

the dynamic shield part comprises a shield bracket;

an inner side mobile shield and an outer side mobile shield which are connected to each other and arranged on two sides of a central axis of the shield bracket;

wherein the outer side mobile shield and the inner side mobile shield are slidingly connected on the shield bracket;

a notch formed between the inner side mobile shield and the outer side mobile shield, and a traction rope runs through the notch, the traction rope being positioned between the inner side mobile shield and the outer side mobile shield;

wherein a support frame is arranged on the central axis of the shield bracket;

two electric contact switches facing opposite directions are arranged on the support frame, and springs are respectively arranged on two sides of the support frame;

front ends of the springs are connected to the inner side mobile shield.

5. A mobile car sheave shield comprising:

a static shield part to be positioned about a car sheave, wherein an opening is formed on an upper surface of the static shield part;

a dynamic shield part arranged on the opening;

the dynamic shield part comprises a shield bracket;

an inner side mobile shield and an outer side mobile shield which are connected to each other and arranged on two sides of a central axis of the shield bracket;

wherein the outer side mobile shield and the inner side mobile shield are slidingly connected on the shield bracket;

a notch formed between the inner side mobile shield and the outer side mobile shield, and a traction rope runs through the notch, the traction rope being positioned between the inner side mobile shield and the outer side mobile shield;

wherein both the inner side mobile shield and the outer side mobile shield are provided with upper shield plates on an upper side and lower shield plates on a lower side;

the two upper shield plates are parallel to each other and the two lower shield plates are parallel to each other, and fixed roller mechanisms are respectively arranged on opposite surfaces of the inner side mobile shield and the outer side mobile shield.

6. The mobile car sheave shield according to claim 5, wherein the fixed roller mechanism comprises a shaft base on the inner side mobile shield or outer side mobile shield;

a rolling shaft is arranged on the shaft base;

a hearing is fixed on the rolling shaft;

a roller is fixed on the bearing, and a front end of the roller is exposed out of the front end of the upper shield plate.

7. The mobile car sheave shield according to claim 5, wherein the outer side mobile shield is a structure which is inclined.

* * * * *